US011224253B2

(12) United States Patent
Fernando et al.

(10) Patent No.: US 11,224,253 B2
(45) Date of Patent: Jan. 18, 2022

(54) SHISHA CARTRIDGE HAVING A PLURALITY OF CHAMBERS

(71) Applicant: PHILIP MORRIS PRODUCTS S. A., Neuchâtel (CH)

(72) Inventors: Felix Fernando, Old Basing (GB); Michael Paton, Royston (GB); David Cross, Willian (GB); Eva Saade Latorre, Colombier (CH); Terence John Wilby, Melbourn (GB)

(73) Assignee: Philip Morris Products S.A., Neuchâtel (CH)

( * ) Notice: Subject to any disclaimer, the term of this patent is extended or adjusted under 35 U.S.C. 154(b) by 0 days.

(21) Appl. No.: 16/621,092

(22) PCT Filed: Jun. 26, 2018

(86) PCT No.: PCT/IB2018/054719
§ 371 (c)(1),
(2) Date: Dec. 11, 2019

(87) PCT Pub. No.: WO2019/003117
PCT Pub. Date: Jan. 3, 2019

(65) Prior Publication Data

US 2020/0113235 A1 Apr. 16, 2020

(30) Foreign Application Priority Data

Jun. 28, 2017 (EP) ..... 17178428

(51) Int. Cl.
*A24F 40/42* (2020.01)
*A24F 40/465* (2020.01)
(Continued)

(52) U.S. Cl.
CPC ..... *A24F 40/42* (2020.01); *A24F 1/30* (2013.01); *A24F 40/20* (2020.01); *A24F 40/30* (2020.01); *A24F 40/465* (2020.01)

(58) Field of Classification Search
None
See application file for complete search history.

(56) References Cited

U.S. PATENT DOCUMENTS 10,842,954 B2 * 11/2020 Reevell ..... A61M 11/042
2015/0090279 A1 4/2015 Chen
(Continued)

FOREIGN PATENT DOCUMENTS

EP 2179667 A1 4/2010
EP 2493342 B1 12/2014
(Continued)

OTHER PUBLICATIONS

Extended European Search Report for EP Application No. 17178428.3, issued by the European Patent Office dated Jan. 15, 2018; 9 pgs.
(Continued)

*Primary Examiner* — James Harvey
(74) *Attorney, Agent, or Firm* — Mueting Raasch Group

(57) ABSTRACT

A shisha consumable cartridge includes a housing having an exterior surface sized and shaped for operable insertion into a shisha device. The cartridge further includes a first chamber in the housing; a first aerosol-generating substrate in the first chamber; a second chamber in the housing and adjacent to the first chamber. A second aerosol-generating substrate in the second chamber. The compositions of the first aerosol-generating substrate and the second aerosol-generating substrate may be the same or different. The first chamber defines a first fresh air inlet and an opposing first aerosol outlet, such that, in use, fresh air entering the first fresh air inlet carries aerosol generated from through the first aerosol outlet. The
(Continued)

second chamber defines a second fresh air inlet and an opposing second aerosol outlet, such that, in use, fresh air entering the second fresh air inlet carries aerosol generated from through the second aerosol outlet.

16 Claims, 4 Drawing Sheets

(51) Int. Cl.

| | |
|---|---|
| ***A24F 40/20*** | (2020.01) |
| ***A24F 1/30*** | (2006.01) |
| ***A24F 40/30*** | (2020.01) |

(56) References Cited

U.S. PATENT DOCUMENTS

| | | | | |
|---|---|---|---|---|
| 2017/0251718 | A1* | 9/2017 | Armoush | H05B 6/105 |
| 2018/0168231 | A1* | 6/2018 | Reevell | A61M 11/042 |
| 2020/0113235 | A1* | 4/2020 | Fernando | A24F 40/465 |
| 2020/0205469 | A1* | 7/2020 | Fernando | A24F 40/57 |
| 2020/0268056 | A1* | 8/2020 | Goldstein | A24F 40/42 |

FOREIGN PATENT DOCUMENTS

| | | | |
|---|---|---|---|
| EP | 3170766 | A1 | 5/2017 |
| RU | 121706 | U1 | 11/2012 |
| WO | WO 2014/102092 | A1 | 7/2014 |
| WO | WO 2015/043132 | A1 | 11/2015 |
| WO | WO 2015/172224 | A1 | 11/2015 |
| WO | WO 2015/177255 | A1 | 11/2015 |
| WO | WO 2016/082851 | A1 | 6/2016 |
| WO | WO 2016/147396 | A1 | 9/2016 |

OTHER PUBLICATIONS

International Search Report and Written Opinion for PCT/IB2018/054719, issued by the European Patent Office dated Oct. 22, 2018; 16 pgs.

International Preliminary Report on Patentability for PCT/IB2018/054719, issued by the European Patent Office dated May 28, 2019; 17 pgs.

Russian Office Action for RU 2019142115 issued by the patent Office of the Russian Federation dated Oct. 1, 2021; 11 pgs. including English translation.

* cited by examiner

SHISHA CARTRIDGE HAVING A PLURALITY OF CHAMBERS

This application is the § 371 U.S. National Stage of International Application No. PCT/IB2018/054719, filed 26 Jun. 2018, which claims the benefit of European Application No. 17178428.3, filed 28 Jun. 2017.

The present disclosure relates to a cartridge having two or more chambers and containing an aerosol-generating substrate for use with a shisha device configured to heat but not combust the aerosol-generating substrate disposed within the chambered cartridge.

Shisha devices are used to smoke tobacco and are configured such that vapor and smoke pass through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapour and smoke produced, to alter flavour, or both. Charcoal pellets are typically used to heat the tobacco in a shisha device, which may cause full or partial combustion of the tobacco or other ingredients.

Some shisha devices have been proposed that use electrical heat sources to combust the tobacco to, for example, avoid by-products of burning charcoal or to improve the consistency with which the tobacco is combusted. Other shisha devices have been proposed that employ e-liquids rather than tobacco. Shisha devices that employ e-liquids eliminate combustion by-products, but deprive shisha consumers of the tobacco-based experience.

It is desirable to provide a shisha device that employs a substrate that does not result in combustion by-products, while providing an expected shisha experience.

It is also desirable to provide a shisha device configured for use with an aerosol-generating substrate, such as a tobacco substrate, in a convenient consumable form.

It is also desirable to provide a shisha consumable that may be efficiently heated. It is also desirable to provide a shish consumable that permits complete or near complete consumption of the aerosol-generating substrate without overheating.

It is also desirable to provide a shisha consumable that may be customized to provide two or more different types or aerosol generating substrate to provide a unique user experience.

In various aspects of the present invention there is provided a shisha consumable cartridge comprising a housing having an exterior surface sized and shaped for operable insertion into a shisha device. The cartridge further comprises a first chamber in the housing; a first aerosol-generating substrate in the first chamber; a second chamber in the housing, wherein the second chamber is adjacent to the first chamber; and a second aerosol-generating substrate in the second chamber, wherein the compositions of the first aerosol-generating substrate and the second aerosol-generating substrate are the same or different. The first chamber defines a first fresh air inlet and an opposing first aerosol outlet, such that, in use, fresh air entering the first fresh air inlet carries aerosol generated from through the first aerosol outlet. The second chamber defines a second fresh air inlet and an opposing second aerosol outlet, such that, in use, fresh air entering the second fresh air inlet carries aerosol generated from through the second aerosol outlet. Preferably, the first and second chambers are formed from thermally conductive material, material susceptible to magnetic heat induction, or both thermally conductive material and material susceptible to magnetic heat induction. Preferably, the cartridge comprises one or more additional chambers in addition to the first and second chambers. The one or more additional chambers may contain aerosol generating substrate. Preferably, at least one of the one or more additional chambers are free of aerosol generating substrate. The chambers that are free of aerosol generating substrate may be empty. Empty chambers may serve to prevent overheating of the cartridge; particularly overheating of aerosol-generating substrate disposed in other chambers. Preferably, the chambers storing the aerosol-generating substrate are sized and shaped to allow consumption of substantially all of the aerosol-generating substrate by heating the substrate without burning the substrate. Preferably, the chambers containing aerosol-generating substrate, or at least the portion of the chambers containing the aerosol-generating substrate, have an aspect ratio (a ratio of length to width or a ratio of width to length) of at least about 1.5 to 1, at least about 2 to 1 or at least about 3 to 1.

In various aspects, there is provided a shisha assembly comprising a cartridge receptacle configured to operably receive a shisha consumable cartridge of the invention. The shisha assembly, further comprises a vessel defining an interior configured to contain a volume of liquid. The vessel comprises a head space outlet conduit. The shisha assembly further comprises a heating element configured to heat the shisha consumable cartridge to heat aerosol-generating substrate in the cartridge. The heating element may comprise an electrically resistive heating element, and inductive heating element, or both a resistive and an inductive heating element. Preferably, the heating element is configured to heat but not burn the aerosol-generating substrate contained within the shisha consumable cartridge during operation. The shisha assembly also comprises an aerosol outlet in fluid connection with the cartridge receptacle and a fresh air inlet channel in fluid connection with the cartridge receptacle.

Various aspects or embodiments of the shisha consumable cartridges and shisha assemblies described herein may provide one or more advantages relative to existing shisha consumables and shisha assemblies. For example, the shisha consumable cartridges of the present invention include a plurality of chambers that may be sized and shaped to allow for consumption of substantially all of the aerosol-generating substrate by heating the substrate without burning the substrate. For example, the aspect ratio of the chambers containing aerosol-generating substrate may be designed to allow sufficient and efficient heating of all of the substrate. In some example, the chambers have aspect ratios of at least about 1.5:1, at least about 2:1, or at least about 3:1. The size and shape of the chamber may also allow for heating of substantially all the aerosol-generating substrate within chamber to an extent sufficient to cause aerosol formation without combusting the aerosol-generating material. In some examples, the shisha consumable cartridges also include at least one empty chamber to prevent overheating, thus preventing combustion of aerosol-generating substrate in the cartridge; for example, to prevent overheating of aerosol-generating substrate in a chamber adjacent to the empty chamber. By way of another example, various aspects of the shisha consumable cartridges described herein may comprise more than one aerosol-generating substrate, allowing a consumer to choose a combination of aerosol-generating substrates that suits their personal taste. These and other advantages will be apparent to those of skill in the art upon reading the disclosure presented herein.

A shisha consumable cartridge of the present invention includes two or more chambers containing an aerosol generating substrate. Preferably, the cartridge comprises three or more chambers, 5 or more chambers, or 7 or more chambers. The shisha consumable cartridge may include any suitable number of chambers. In some examples, the shisha consumable cartridge comprises 100 or less chambers, 80 or less chamber or 40 or less chambers.

The number, configuration and dimensions of the channels may be tailored to increase the amount of aerosol-generating substrate that may be consumed during use of the cartridge in a shisha assembly relative to a shisha device having a single compartment in which the aerosol-generating substrate is contained. Segmenting the cartridge to include a plurality of chambers, rather than one large chamber, may provide for heating of smaller portions of aerosol-generating substrate to allow for substantial depletion of the aerosol from the aerosol-generating substrate; particularly if the chambers contribute to the heating of the substrate. Preferably, the chambers contribute to heating the substrate.

If the cartridge is configured for use in a shisha assembly that heats, at least in part, through conduction, the chambers, or a portion of the chambers, are preferably formed from thermally conductive material. Any suitable thermally conductive material may be used to form a chamber or a portion of the chamber. Examples of suitable thermally conductive materials include aluminium, copper, zinc, nickel, silver, and combinations thereof. Preferably, the chambers are formed from aluminium.

If the cartridge is configured for use in a shisha assembly that heats through induction, the chambers, or a portion of the chambers, are formed from a susceptor material. Any suitable susceptor material may be used to form a chamber or a portion of the chamber. As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate, the substrate is heated by the susceptor such that an aerosol is formed. Preferably, the susceptor is arranged at least partially in direct physical contact with the aerosol-forming substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, a ferromagnetic alloy, such as ferromagnetic steel or stainless steel, and ferrite. A suitable susceptor may be, or comprise, aluminium.

Preferred susceptors are metal susceptors, for example stainless steel. However, susceptor materials may also comprise or be made of graphite, molybdenum, silicon carbide, aluminium, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor preferably comprises more than 5%, preferably more than 20%, preferably more than 50% or 90% of ferromagnetic or paramagnetic materials. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core.

In the system according to the invention, the base and the at least one side wall of the cartridge may comprise susceptor material. Preferably, base and the at least one side wall comprise susceptor material. Advantageously, at least portions of an outer side of the housing of the cartridge are made of susceptor material. However, also at least portions of an inner side of the housing of the cartridge may be coated or lined with susceptor material. Preferably, a lining is attached or fixed to the housing such as to form an integral part of the shell.

The sidewalls of one or more chambers may comprise a susceptor material.

A chamber, or a portion thereof, may be formed from one or both of a thermally conductive material and susceptor material.

If the cartridge is configured for use in a shisha assembly that heats through induction and the chamber, or a portion of the chamber, is formed from a susceptor material, the cartridge is preferably positioned in the shisha assembly in a manner such that a minimal surface area of the susceptor material is parallel to the magnetic field. The cartridge and a receptacle of the shisha assembly may comprise keyed features to ensure proper orientation of the cartridge in the receptacle and thus proper orientation of the chambers in the shisha device. In addition or alternatively, the chambers may be shaped to reduce the surface area that may be parallel to the inductive magnetic field. For example, the chambers may be cylindrical and have a round cross-sectional shape. Polygonal prisms having 5 or more sides may also desirably limit the portion of the chamber, and thus susceptor material, that may be parallel to the inductive magnetic field.

Regardless of the shape of the chambers, the chambers are preferably tightly packed. Tightly packed chambers may enhance efficiency of heating through conduction of heat from one chamber to an adjacent chamber. Preferably, a chamber abuts one or more other chamber to enhance heat transfer between chambers by conduction. Preferably, a wall of a first chamber serves as a wall of a second chamber. A particularly preferred arrangement of chambers is a close-packed hexagonal prism array, for example, a uniform hexagonal prism array such as a honeycomb structure.

Regardless of the exact arrangement of the chambers in the cartridge, on average 50% or more of the exterior surface area of a chamber abuts or forms a part of an abutting chamber. More preferably, on average 70% or more or 80% or more of the exterior surface area of a chamber abuts or forms a part of an abutting chamber. In some examples, such as in a honeycomb type structure, 100% of the exterior surface of at least some chambers may abut one or more other chambers.

The chambers may be of any suitable size and shape. The size and shape of the chambers may be uniform or may be non-uniform. Preferably, all or at least some of the chambers have substantially the same shape and size.

In some examples, the chambers have a length in a range from about 5 mm to about 30 mm, such as from about 10 mm to about 20 mm, or from about 14 mm to about 18 mm. Such chambers may have a width from about 3 mm to about 20 mm, such as from about 4 mm to about 10 mm or about 5 to about 7 mm. In some examples, the chambers have a length from about 14 mm to about 18 mm and a width from about 5 mm to about 7 mm.

Two or more of the chambers of the cartridge may contain aerosol-generating substrate. In some examples, all the chambers of the cartridge contain aerosol-generating substrate. In some examples, at least one of the chambers of the cartridge is empty and is free of aerosol-generating substrate. Empty chambers may prevent overheating of the contents of the cartridge by allowing excess heat to be carried away from the containers.

The chambers of the cartridge have a fresh air inlet and an aerosol outlet. The fresh air inlet allows fresh air to flow into the cartridge as a user draws on the shisha apparatus. The air then carries aerosol formed from the aerosol-generating article in the chamber through the aerosol outlet. The fresh air inlet and the aerosol outlet of the chamber are preferably at opposing ends of the chamber.

In some examples, a sidewall comprises one or more apertures to allow airflow between chambers. If the same sidewall forms a portion of a first and a second chamber, an aperture in the sidewall will allow for airflow between the first and second chambers. The number, size and shape of the apertures may be controlled to tailor the amount of air than may flow between chambers. The apertures may be any suitable size and shape. The size and shape may be uniform or non-uniform. Preferably, all or at least some of the apertures have the same size and shape. The apertures may be distributed in a uniform or non-uniform manner. Airflow between channels is preferably tailored to enhance consumption (depletion of aerosol) of aerosol-generating substrate in one or more chambers.

The cartridge comprises a housing in which the chambers are disposed. The housing defines an exterior surface configured to be received by a shisha assembly. The housing may comprise one or more inlets in communication with the fresh air inlets of the chambers and may comprise one or more outlets in communication with the aerosol outlets of the chambers. If the number of inlets or outlets of the housing are less than the number of fresh air inlets or aerosol outlets of the chambers, the cartridge may comprise a manifold to fluidly connect more than fresh air inlet of a chamber to an inlet of the housing or to fluidly connect more than aerosol outlet of a chamber to an outlet of the housing. Preferably, the housing comprises the same number of inlets as the number of chambers and the same number of outlets as the number of chambers.

The inlets, outlets, length, size and dimensions of the chambers, the presence or absence of aerosol-generating substrate in the chambers, the amount of aerosol-generating substrate in the chambers, and the size and shape of the inlets and outlets of the housing, among other things, may be chosen to provide the cartridge with any suitable resistance to draw (RTD). Aspects of the present invention will be evident based on the present disclosure. Preferably, the size and shape of the inlets of the housing are primarily responsible to controlling the RTD through the cartridge.

Cartridges of the present invention may have any suitable RTD. For example, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation blocked.

The housing may be formed from one or more part. For example, the housing may comprise a sidewall and a bottom as a single part and may comprise a separate top or lid. The one or more inlet of the housing is preferably defined by the top or lid, while the one or more outlet is preferably defined by the bottom.

The housing may be formed from any suitable material. Preferably, the housing is formed from a heat resistant material, such as a heat resistant polymer or metal. Preferably, the housing is formed from a thermally conductive material. For example, the housing may be formed from aluminium, copper, zinc, nickel, silver, and combinations thereof. Preferably, the housing is formed from aluminium.

The chambers may be formed from one or more part. Preferably, the chambers are formed from a single part. The chambers may be inserted into the housing or may be formed from a single part that includes at least a portion the housing.

The cartridge may be of any suitable shape configured to be received by a shisha apparatus. If the shisha device is configured to heat the aerosol-generating substrate in the cartridge by conduction, the cartridge is preferably shaped and sized to allow contact between a heating element of the shisha device. Preferably, an interior of a cartridge receptacle and the exterior of the cartridge are of similar size and dimensions. In some examples, the cartridge has a height to a base width (or diameter) ratio of greater than about 1.5 to 1 or a base width (or diameter) ratio of greater than about 1.5 to 1. Such ratios may allow for more efficient depletion of the aerosol generating substrate within the cartridge during use by allowing heat from the heating elements to penetrate to the middle of the cartridge. For example, the cartridge may have a base diameter (or width) about 1.5 to about 5 times the height, or about 1.5 to about 4 times the height, or about 1.5 to about 3 times the height. Similarly, the cartridge may have a height about 1.5 to about 5 times the base diameter (or width), or about 1.5 to about 4 times the base diameter (or width), or about 1.5 to about 3 times the base diameter (or width). Preferably, the cartridge has a height to base diameter ratio or base diameter to height ratio of from about 1.5 to 1 to about 2.5 to 1.

In some examples, the cartridge has a height in a range from about 15 mm to about 25 mm and a base diameter in a range from about 40 mm to about 60 mm.

The cartridge may be of any suitable shape. For example, the cartridge may have a substantially cuboidal shape or a frustro-conical shape. Preferably, the cartridge has a frustro-conical shape.

A shisha consumable cartridge as described herein may include any suitable aerosol generating substrate. Each chamber of the cartridge that contains aerosol-substrate may contain the same aerosol generating substrate. Alternatively, one or more chambers may contain an aerosol-generating substrate that is different from the aerosol-generating substrate contained within a different chamber. A consumer may select a cartridge comprising a combination of aerosol-generating substrates to suit their personal taste.

The aerosol-generating substrate is preferably a substrate capable of releasing volatile compounds that may form an aerosol. The volatile compounds may be released by heating the aerosol-generating substrate. The aerosol-generating substrate may be solid or liquid or comprise both solid and liquid components. Preferably, the aerosol-generating substrate is solid.

The aerosol-generating substrate may comprise nicotine. The nicotine containing aerosol-generating substrate may comprise a nicotine salt matrix. The aerosol-generating substrate may comprise plant-based material. The aerosol-generating substrate may comprise tobacco, and preferably the tobacco containing material contains volatile tobacco flavor compounds, which are released from the aerosol-generating substrate upon heating.

The aerosol-generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 30% by weight on a dry weight basis. The aerosol-former content may be less than about 95% on a dry weight basis. Preferably, the aerosol-former content is up to about 55%.

The aerosol-generating substrate may alternatively or additionally comprise a non-tobacco-containing material. The aerosol-generating substrate may comprise homogenized plant-based material.

The aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-generating substrate preferably comprises nicotine and at least one aerosol-former. In a particularly preferred embodiment, the aerosol-former is glycerine.

The solid aerosol-forming substrate may be provided on or embedded in a thermally stable carrier. The carrier may comprise a thin layer on which the solid substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose derivative fibers.

In some examples, the aerosol generating substrate is in the form of a suspension. For example, the aerosol generating substrate may be in the form of a thick, molasses-like, suspension.

In some examples, the aerosol-generating substrate comprises one or more sugars in any suitable amount. Preferably, the aerosol-generating substrate comprises invert sugar, which is a mixture of glucose and fructose obtained by splitting sucrose. Preferably, the aerosol-generating substrate comprises from about 1% to about 40% sugar, such as invert sugar, by weight. In some example, one or more sugars may be mixed with a suitable carrier such as cornstarch or maltodextrin.

In some examples, the aerosol-generating substrate comprises one or more sensory-enhancing agent. Suitable sensory-enhancing agents include flavorants and sensation agents, such as cooling agents. Suitable flavorants include natural or synthetic menthol, peppermint, spearmint, coffee, tea, spices (such as cinnamon, clove and/or ginger), cocoa, vanilla, fruit flavors, chocolate, eucalyptus, geranium, eugenol, agave, juniper, anethole, linalool, and any combination thereof.

Any suitable amount of aerosol-generating substrate may be placed in the cartridge. Preferably, the cartridge comprises an amount of aerosol-generating substrate that will provide a sufficient amount of aerosol for a shisha experience lasting from about 10 minutes to about 60 minutes; preferably from about 20 minutes to about 50 minutes; and more preferably from about 30 minutes to about 40 minutes. In some examples, the cartridge comprises from about 5 grams to about 50 grams of aerosol-generating substrate. For example, the cartridge may comprise from about 10 grams to about 25 grams of aerosol-generating substrate. Preferably, the cartridge comprises from about 10 grams to about 20 grams, or about 15 grams, of aerosol-generating substrate.

A shisha consumable cartridge according to the present invention may be used with any suitable shisha assembly. Preferably, the shisha assembly is configured to sufficiently heat the aerosol-generating substrate in the cartridge to cause formation of aerosol from the aerosol-generating substrate but not to combust the aerosol-generating substrate. For example, the shisha device may be configured to heat the aerosol-generating substrate to a temperature in a range from about 150° C. to about 250° C.; more preferably from about 180° C. to about 230° C. or from about 200° C. to about 230° C.

The shisha assembly may be configured to heat by conduction, convection, induction or a combination of two or more of conduction, convection and induction. If the shisha assembly is configured to heat by induction, the chambers of the cartridge preferably comprise a susceptor material. The shisha assembly may comprise an inductive heating element. For example, the shisha assembly may comprise one or more induction coil configured to induce eddy currents and/or hysteresis losses in the susceptor material, which results in heating of the susceptor material. Suitable susceptor materials and induction heating configurations that may be employed in shisha devices of the present invention include those described in, for example, PCT Published Patent Applications WO 2014/102092 and WO 2015/177255.

If the shisha assembly is configured to heat the aerosol generating substrate in the cartridge by conduction, the shisha assembly preferably comprises a heating element that contacts or is in close proximity to housing of the cartridge when the cartridge is operably received by the shisha assembly. The heating element may comprise a resistive heating component. For example, the heating element may comprise one or more resistive wires or other resistive elements. The resistive wires may be in contact with a thermally conductive material to distribute heat produced over a broader area. Examples of suitable conductive materials include aluminium, copper, zinc, nickel, silver, and combinations thereof. For purposes of this disclosure, if resistive wires are in contact with a thermally conductive material, both the resistive wires and the thermally conductive material are part of the heating element that forms at least a portion of the surface of the cartridge receptacle.

Regardless of the mechanism by which the shisha assembly heats the aerosol generating substrate in the cartridge, the shisha assembly may comprise control electronics operably coupled to the heating element to control heating of the heating element and thus control the temperature at which the aerosol-generating substrate is heated.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power. The power may be supplied to the heater element in the form of pulses of electrical current.

If the heating element is a resistive heating element, the control electronics may be configured to monitor the electrical resistance of the heating element and to control the supply of power to the heating element depending on the electrical resistance of the heating element. In this manner, the control electronics may regulate the temperature of the resistive element.

If the heating components comprise an induction coil and the heating element comprises a susceptor material, the control electronics may be configured to monitor aspect of the induction coil and to control the supply of power to the induction coil depending on the aspects of the coil such as described in, for example, WO 2015/177255. In this manner, the control electronics may regulate the temperature of the susceptor material.

The shisha device may comprise a temperature sensor, such as a thermocouple, operably coupled to the control electronics to control the temperature of the heating elements. The temperature sensor may be positioned in any suitable location. For example, the temperature sensor may be configured to insert into a cartridge received within the receptacle to monitor the temperature of the aerosol-generating substrate being heated. In addition or alternatively, the temperature sensor may be in contact with the heating element. In addition or alternatively, the temperature sensor may be positioned to detect temperature at an aerosol outlet of the shisha assembly or a portion thereof. The sensor may transmit signals regarding the sensed temperature to the control electronics, which may adjust heating of the heating elements to achieve a suitable temperature at the sensor.

The shisha device, or the heating element of the shisha device may be configured (i) to heat different chambers of the cartridge at different temperatures, (ii) to heat different chambers of the cartridge at different times, (iii) to heat one or more chambers of the cartridge using a varying temperature profiles, or any combination of one or more of (i)-(iii). Heating different chambers of the cartridge at different temperatures may be advantageous where different chambers or sections of the cartridge comprise different aerosol forming substrates. This may be particularly advantageous where the different aerosol forming substrates or components thereof have different vaporization temperatures. Heating different chambers of the cartridge at different times may advantageously extend the time until the substrate is depleted, may deliver a suitable amount of aerosol at a given time, or both. In other words, heating one or more chamber of the cartridge at a given time, rather than heating the entire cartridge, may allow for extended use of the cartridge because the substrate may not be prematurely depleted. Heating one or more chambers of the cartridge at a given time, rather than heating the entire cartridge, may allow for a suitable amount of aerosol, rather an excess, to be generated at a given time. In some preferred embodiments, the heating elements of the shisha devices may be configured to sequentially heat one or more chamber of the cartridge at any suitable time. Sequentially heating one or more chambers of the cartridge may advantageously help to prevent premature substrate depletion. In some embodiments, there may be an overlap in the heating of the chambers of the cartridge. For example, a first chamber of the cartridge may first be heated. Heating of a second chamber of the cartridge may be commenced before heating of the first chamber is complete and the substrate within the first chamber is depleted. This may be repeated until substrate within the entire cartridge is depleted. Advantageously, a sequential yet blended heating of the chambers of the cartridge allows a substrate within a subsequently heated chamber to be preheated before depletion of a substrate in a preceding heated chamber. Advantageously, this reduces or eliminates any waiting time for the user between consumption of a substrate within the first and second chambers. The first, second and any subsequent heating profiles may be the same as each other, or one or more may be different.

Heating one or more chambers of the cartridge, or the entire cartridge, using a varying temperature profile may advantageously be employed. Such a method may first allow aerosol production from a first substrate having a first volatilization temperature and then to allow aerosol production from a substrate having a second volatilization temperature, where the first volatilization temperature is lower than the second volatilization temperature. The first and second substrates may be the same as each other or may be different from each other. The first and second substrates may be provided in different chambers of the cartridge. The first and second volatilization temperatures may be different from each other. The first volatilization temperature may be a lower temperature than the second volatilization temperature, or vice versa. Heating one or more chambers of the cartridge using a varying temperature profile, rather than a constant temperature, may allow for (i) the aerosol to be produced only at certain times, rather than continuously, to extend the time to depletion of the substrate, (ii) the power consumption of the device to be reduced, or both (i) and (ii). One example of a varying temperature profile that may be employed is heating the cartridge, such as one or more particular sections or chambers of the cartridge to different temperatures includes gradually increasing heater temperature to a working temperature. Another example of a varying temperature profile that may be employed is rapidly heating the cartridge, such as one or more particular sections or chambers, to a first temperature and then gradually increasing the temperature to a second temperature. The first temperature may be a temperature just below a volatilization temperature of the substrate. The second temperature may be a temperature, equal to or above the volatilization temperature of the substrate. In another example of a varying temperature profile, the device or heating element may be configured to hold the temperature at the first temperature for a period of time before increasing the temperature to the second temperature.

A particular heating profile may be applied for each of the chambers of the cartridge. The chambers may each have different heating profiles. Some chambers may have the same heating profile. In some embodiments, the heating profiles may be applied to each of the chambers in a sequentially manner. In some embodiments, a first heating profile may be applied to a first chamber until the substrate within the first chamber is substantially depleted. A second heating profile may then be applied to a second chamber until the substrate within the second chamber is substantially depleted. This may be repeated until substrate within the entire cartridge is depleted. The first, second and any subsequent heating profiles may be the same as each other, or one or more may be different. In some embodiments, there may be an overlap in the application of heating profiles to each of the chambers of the cartridge. For example, a first heating profile may be applied to a first chamber of the cartridge. A second heating profile may then be applied to a second chamber of the cartridge before the first heating profile applied to the first chamber is complete and the substrate within the first chamber is depleted. This may be repeated until substrate within the entire cartridge is depleted. Advantageously, a sequential yet blended application of heating profiles to chambers of the cartridge allows a substrate within a subsequently heated chamber to be preheated before depletion of a substrate in a preceding heated chamber. Advantageously, this reduces or eliminates any waiting time for the user between consumption of a substrate within the first and second chambers. The first, second and any subsequent heating profiles may be the same as each other, or one or more may be different.

Overheating of the substrate may occur with cartridges having multiple chambers as described in the present disclosure, and the substrate may be prematurely depleted. Such a problem may be solved by configuring shisha devices such as above described. For example, such a problem may be solved by configuring shisha devices in which the heating elements provide for one or more of (i) heating different chambers of the cartridge at different temperatures, (ii) heating different chambers of the cartridge at different times, (iii) sequentially heating the chambers of the cartridge, (iv) sequentially heating the chambers of the cartridge in an overlapping manner, (v) heating one or more chamber of the cartridge using a varying temperature profile and (vi) any combination of (i) to (v).

The shisha device may be configured in any suitable manner to (i) to heat different sections of the cartridge at different temperatures, (ii) to heat different sections of the cartridge at different times, (iii) sequentially heating the chambers of the cartridge, (iv) sequentially heating the chambers of the cartridge in an overlapping manner, (v) to heat one or more section of the cartridge using a varying temperature profiles, or any combination of one or more of (i)-(iv). The shisha device may comprise two or more independently controllable heating elements for heating the different sections or chambers of the cartridge. At least one of the heating elements is configured to heat different sections of the cartridge at different times, to differing temperatures, or via different temperature profiles. In some embodiments, the shisha device may comprise a single heating element configured to heat different chambers of the cartridge at different times, to differing temperatures, or via different temperature profiles. The timing, temperature, and temperature profile of heating of the heating elements may be controllable by the control electronics.

The control electronics may be operably coupled to a power supply. The shisha device may comprise any suitable power supply. For example, a power supply of a shisha device may be a battery, or set of batteries. In some examples, the cathode and anode elements can be rolled and assembled to match geometries of a portion of a shisha device in which they are disposed. The batteries of power supply unit can be rechargeable, as well as it may be removable and replaceable. Any suitable battery may be used. For example, heavy duty type or standard batteries existing in the market, such as used for industrial heavy duty electrical power-tools. Alternatively, the power supply unit can be any type of electric power supply including a super or hyper-capacitor. Alternatively, the assembly can be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-generating substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha assembly includes an aerosol generating element that comprises a cartridge receptacle, a heating element, an aerosol outlet, and a fresh air inlet. The cartridge receptacle is configured to receive a cartridge containing the aerosol generating substrate. The heating element defines at least two surfaces of the receptacle. For example, the heating element may form at least a portion of two or more of a top surface, a side surface, and a bottom surface. Preferably, the heating element defines at least a portion of the top surface and at least a portion of a side surface. More preferably, the heating element forms the entire top surface and an entire side wall surface of the receptacle. The heating element may be disposed on an inner surface or an outer surface of the receptacle.

The shisha device comprises a fresh air inlet channel in fluid connection with the receptacle. Fresh air flows through the channel to the receptacle and the chambers in the cartridge disposed into the receptacle to carry aerosol generated from the aerosol generating substrate in the chambers of the cartridge to the aerosol outlet when the shisha device is in use. Preferably, at least a portion of the channel is formed by a heating element to preheat the air prior to entering the receptacle or cartridge. Preferably, a portion of the heating element that forms a surface of the cartridge receptacle forms a portion of the fresh air inlet channel. Preferably the fresh air inlet channel is formed from one or both of the top surface of the cartridge receptacle and a side wall of the cartridge receptacle that if formed by the heating element. Preferably, the air inlet channel is formed by both the top surface of the cartridge receptacle and a side wall of the cartridge receptacle that if formed by the heating element.

Any suitable portion of the air inlet channel may be formed by the heating element. Preferably, about 50% or more of the length of the air inlet channel is formed by the heating element. In many examples, the heating element will form 95% or less of the length of the fresh air inlet channel.

Air flowing through the fresh air inlet channel may be heated by any suitable amount by the heating element. In some examples, the air will be sufficiently heated to cause an aerosol to form when the heated air flows through a cartridge containing aerosol generating substrate. In some examples, the air is not sufficiently heated to cause aerosol formation on its own, but facilitates heating of the substrate by the heating elements. Preferably, the amount of energy supplied to the heating elements to heat the substrate and cause aerosol formation is reduced by 5% or more, such as 10% or more, or 15% or more, when the air is pre-heated in accordance with the present invention, relative to designs in which air is not pre-heated. Typically, the energy savings will be less than 75%.

Preferably at least a portion of the air flow channel is formed between the heating element and a heat shield. Preferably, substantially the entire portion of the fresh air inlet channel that is formed by the fresh air inlet channel is also formed by the heat shield. The heat shield and the heating element may form opposing surfaces of the fresh air inlet channel, such that the air flows between the heat shield and the heating element. Preferably, the heat shield is positioned exterior to an interior formed by the cartridge receptacle.

Any suitable heat shield material may be employed. Preferably, the heat shield material comprises a surface that is thermally reflective. The thermally reflective surface may be backed with an insulating material. In some examples, the thermally reflective material comprises an aluminium metalized film or other suitable thermally reflective material. In some examples, the insulating material comprises a ceramic material. In some examples, the heat shield comprises an aluminium metalized film and a ceramic material backing.

The fresh air inlet channel may comprise one or more apertures through the cartridge receptacle such that fresh air from outside the shisha device may flow through the channel and into the cartridge receptacle through the apertures. If a channel comprises more than one aperture, the channel may comprise a manifold to direct air flowing through the channel to each aperture. Preferably, the shisha device comprises two or more fresh air inlet channels.

In some examples, an air gap may be formed between at least a portion of the cartridge and a surface of the receptacle, where the air gaps serve as a portion of the fresh air inlet channel.

The receptacle of the shisha assembly may be formed from one or more parts. Preferably, the receptacle is formed by two or more parts. Preferably, at least one part of the receptacle is movable relative to another part to allow access to the interior of the receptacle for inserting the cartridge into the receptacle. For example, one part may be removably attachable to another part to allow insertion of the cartridge when the parts are separated. The parts may be attachable in any suitable manner, such as through threaded engagement, interference fit, snap fit, or the like. In some examples, the parts are attached to one another via a hinge. When the parts are attached via a hinge, the parts may also include a locking mechanism to secure the parts relative to one another when the receptacle is in a closed position. In some examples, the cartridge receptacle comprises a drawer that may be slid open to allow the cartridge to be placed into the drawer and may be slid closed to allow the shisha device to be used.

As described above, the cartridge comprises one or more inlets formed in the housing to allow air flow through the chambers of the cartridge when in use. If the receptacle comprises one or more inlet apertures, at least some of the inlets in the cartridge may align with the apertures in the top of the receptacle. The cartridge may comprise an alignment feature configured to mate with a complementary alignment feature of the receptacle to align the inlets of the cartridge with the apertures of the receptacle when the cartridge is inserted into the receptacle.

Air that enters the chambers of the cartridge flows across the aerosol generating substrate, entrains aerosol, and exits the chambers, cartridge and receptacle via an aerosol outlet. From the aerosol outlet, the air carrying the aerosol enters a vessel of the shisha assembly.

The shisha assembly may comprise any suitable vessel defining an interior volume configured to contain a liquid and defining an outlet in head-space above a liquid fill level. The vessel may comprise an optically transparent or opaque housing to allow a consumer to observe contents contained in the vessel. The vessel may comprise a liquid fill demarcation, such as a liquid fill line. The vessel housing may be formed of any suitable material. For example, the vessel housing may comprise glass or suitable rigid plastic material. Preferably, the vessel is removable from a portion of the shisha assembly comprising the aerosol-generation element to allow a consumer to fill or clean the vessel.

The vessel may be filled to a liquid fill level by a consumer. The liquid preferably comprises water, which may optionally be infused with one or more colorants, flavorants, or colorant and flavorants. For example, the water may be infused with one or both of botanical or herbal infusions.

Aerosol entrained in air exiting the aerosol outlet of the receptacle may travel through a conduit positioned in the vessel. The conduit may be coupled to the aerosol outlet of the aerosol generating element of the shisha assembly and may have an opening below the liquid fill level of the vessel, such that aerosol flowing through the vessel flows through the opening of the conduit, then through the liquid, into headspace of the vessel and exits the headspace outlet for delivery to a consumer.

The headspace outlet may be coupled to a hose comprising a mouthpiece for delivering the aerosol to a consumer. The mouthpiece may comprise a switch activatable by a user or a puff sensor operably coupled to the control electronics of the shisha device. Preferably, the switch or puff sensor is wirelessly coupled to the control electronics. Activation of a switch or puff sensor may cause the control electronics to activate the heating element, rather than constantly supplying energy to the heating element. Accordingly, the use of a switch or puff sensor may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. A portion of the aerosol generating element may be removed or opened to allow the cartridge to be inserted into the receptacle. The aerosol generating element is then reassembled or closed. The device may then be turned on. The user may puff on the mouth piece as desired. The user may continue using the device until no more aerosol is visible or being delivered. Preferably, the device will automatically shut off when the cartridge is depleted of usable aerosol-generating substrate. Alternatively or in addition, the consumer may refill the device with a fresh cartridge after, for example, receiving the cue from the device that the consumables are depleted or nearly depleted. If refilled with a fresh cartridge, the device may continue to be used. Preferably, the shisha device may be turned off at any time by a consumer by, for example, switching off the device.

In some examples, a user may activate one or more heating elements by using an activation element on, for example, the mouthpiece. The activation element may be, for example, in wireless communication with the control electronics and may signal control electronics to activate the heating element from standby mode to full heating. Preferably, such manual activation is only enabled while the user puffs on the mouthpiece to prevent overheating or unnecessary heating of aerosol-generating substrate in the cartridge.

In some examples, the mouthpiece includes a puff sensor in wireless communication with the control electronics and puffing on the mouthpiece by a consumer causes activation of the heating elements from a standby mode to full heating.

A shisha device of the invention may have any suitable air management. In one example, puffing action from the user will create a suction effect causing a low pressure inside the device which will cause external air to flow through air inlet of the device, into the fresh air inlet channel, and into the receptacle. The air may then flow through chambers of the cartridge in the receptacle to carry aerosol produced from the aerosol generating substrate in the chambers. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers or other sealing elements may be made of any suitable material or materials. For example, the seals may comprise one or more of graphene compounds and silicon compounds. Preferably, the materials are approved for use in humans by the U.S. Food and Drug Administration.

Main parts, such as the conduit from the receptacle, a cover housing of the receptacle, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

In some examples, a mouthpiece of the invention incorporates a quick coupling male/female feature to connect to a hose unit.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 3:
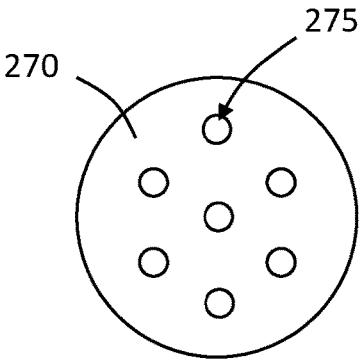
Figure 4:
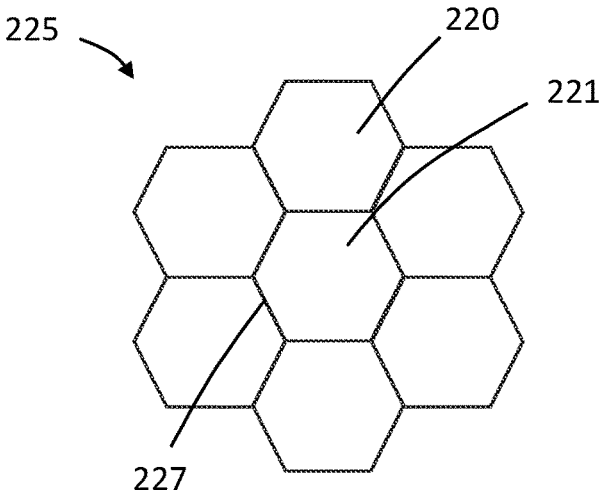
Figure 5:
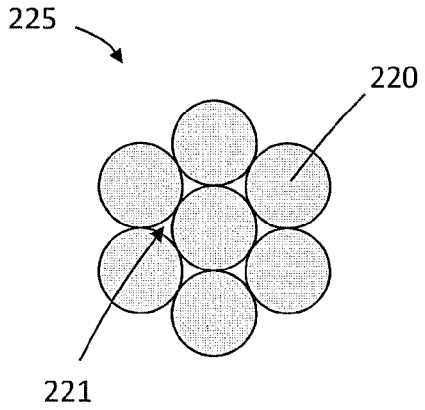

FIG. 3 is a schematic plan view of an example of a bottom of a cartridge. FIG. 4 is a schematic cross-sectional view of an example of an array of chambers. FIG. 5 is a schematic cross-sectional view of an alternative example of an array of chambers.

Figure 6:
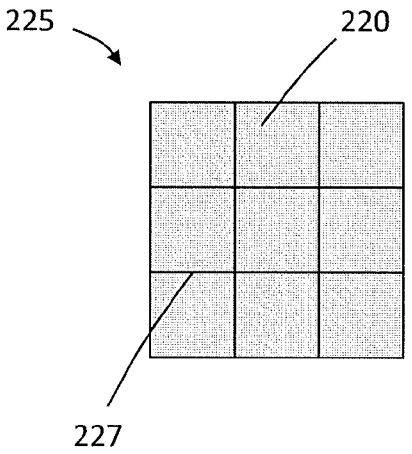

FIG. 6 is a schematic cross-sectional view of an alternative example of an array of chambers.

Figure 7:
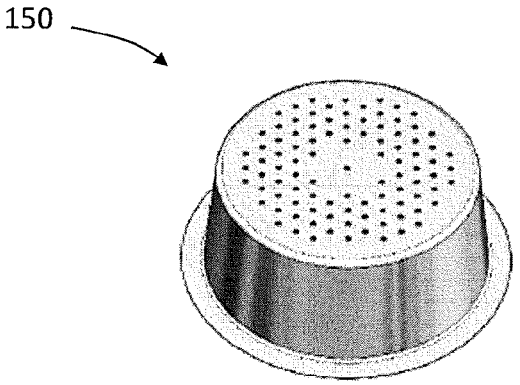

FIG. 7 is a schematic perspective view of an example of a cartridge having a frustro- conical shape.

Figure 8:
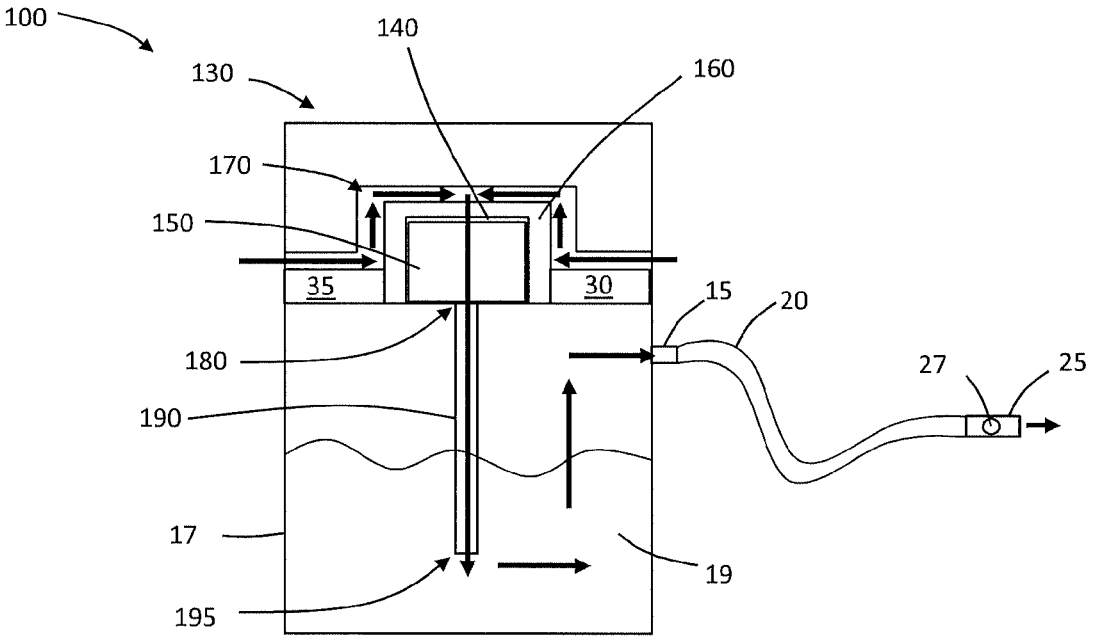

FIG. 8 is a schematic sectional drawing of an example of a shisha assembly.

Figure 9:
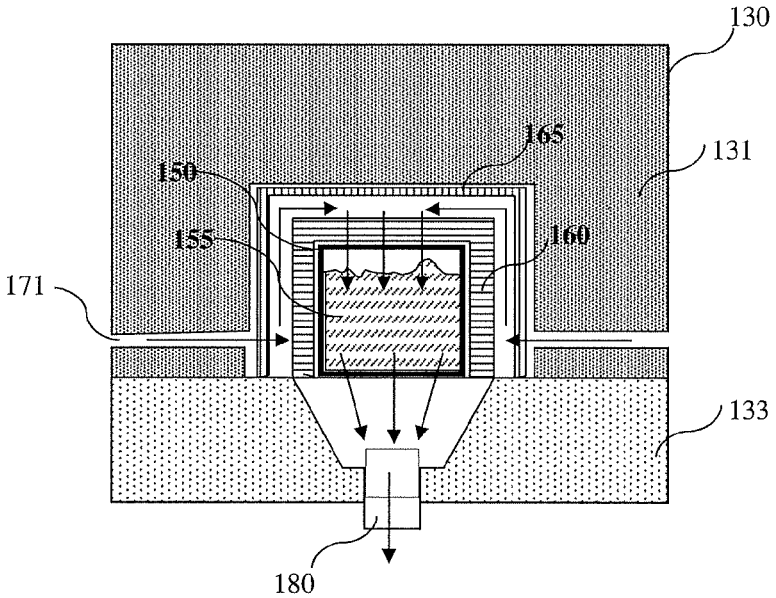

FIG. 9 is a schematic sectional view of an example of an aerosol-generating element.

Figure 10:
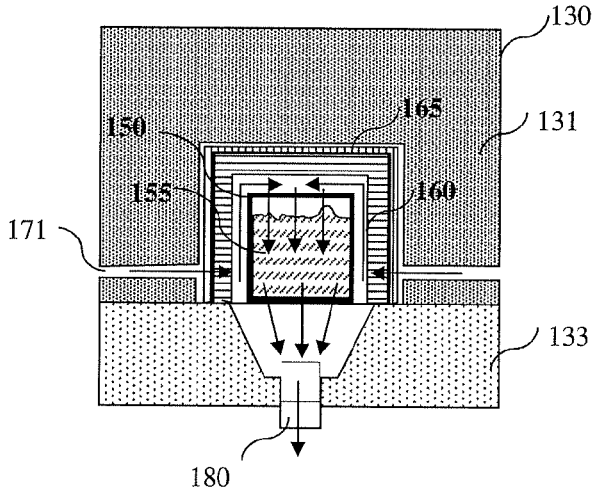

FIG. 10 is a schematic sectional view of an example of an aerosol-generating element.

Figure 11:
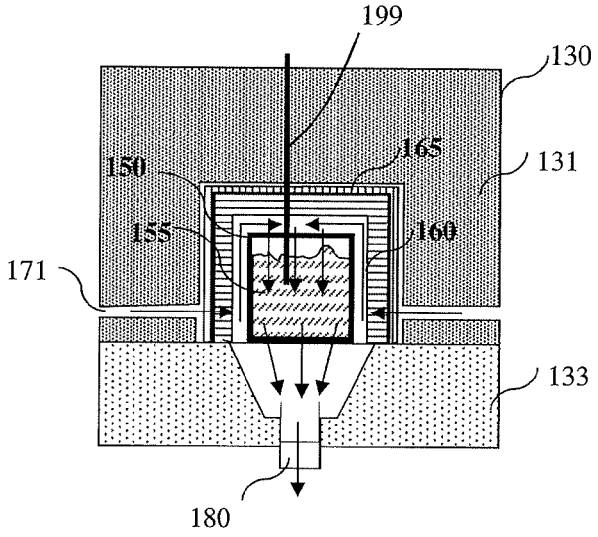

FIG. 11 is a schematic sectional view of an example of an aerosol-generating element.

Figure 1:
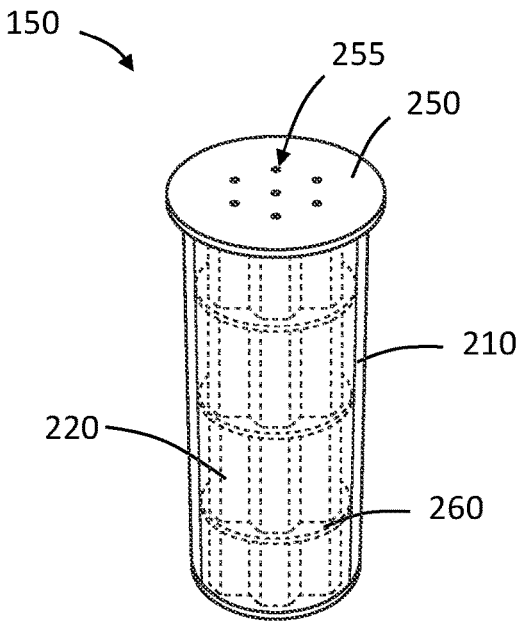
FIG. 1 is a schematic perspective view of an example of a shisha consumable cartridge.
Figure 2:
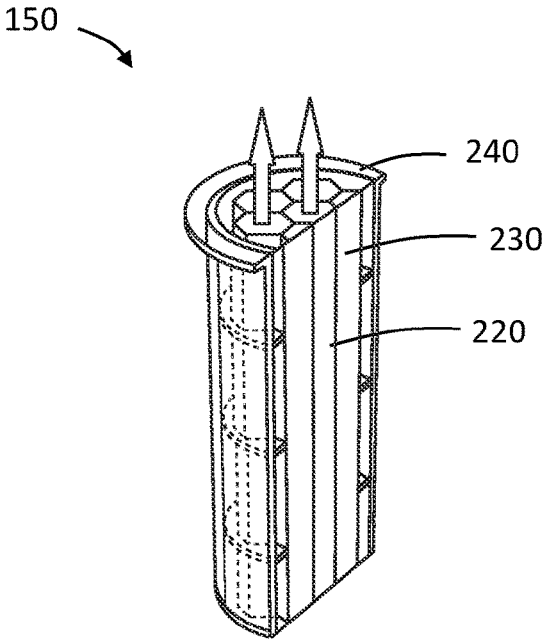
FIG. 2 is a schematic perspective view, longitudinally sectioned, of the shisha consumable cartridge of FIG. 1.

Referring to FIGS. 1-2, a schematic perspective view of an example of a shisha consumable cartridge 150 (FIG. 1) and a schematic perspective view, longitudinally sectioned, of the shisha consumable cartridge 150 (FIG. 2) are shown. The cartridge 150 is configured to be received by a shisha assembly. The cartridge 150 comprises a housing 210 defining an exterior surface sized and shaped to be received by the shisha assembly. A plurality of chambers 220 are disposed in the housing 210. The housing 210 and the chambers 220 may be formed from one or more parts. In some examples, all the chambers 220 are formed from a single part that is inserted into the housing 110. In some examples, at least a portion of the housing 210 and the chambers 220 are formed from the same part.

Aerosol-generating substrate 230 is disposed within two or more of the chambers 220. The arrows extending from the aerosol generating substrate 230 in FIG. 2 illustrate the flow of air through the chambers 220. Accordingly, the arrows extend from aerosol outlets of the chambers 220.

The housing 210 may comprise a flange 240 configured to engage a cover 250. The lid 250 comprises apertures 255 that form outlets of the cartridge 150. The apertures 255 are preferably aligned with the chambers 220 to direct flow from the chambers 220 out of the housing 210 through the cover 250. The apertures 255 are preferably sufficiently small to prevent loose aerosol-generating substrate 230 from spilling out of the apertures 255.

The cartridge 210 depicted in FIGS. 1-2 includes a seal 260 to prevent airflow around the chambers 220 and to direct airflow through the chambers 220.

Referring to FIG. 3, a schematic plan view of an example of a bottom of the cartridge 150 depicted in FIGS. 1-2 is shown. The bottom 270 (bottom relative to FIGS. 1-2) of the housing forms a plurality of apertures 275 that may serve as inlets into the cartridge. The apertures 275 are preferably aligned with the chambers in the housing to direct flow of air from apertures 275 into the chambers of the housing. The apertures 275 are preferably sufficiently small to prevent loose aerosol-generating substrate from spilling out of the apertures 275.

Referring to FIG. 4, a schematic cross-sectional view of an example of an array 225 of chambers 220 is shown. The shaded chambers 220 illustrate chambers that contain aerosol-generating substrate, and the unshaded chamber 221 illustrates an empty chamber. The empty chamber 221 may serve as a heat sink or may transfer excess heat from chambers 220 containing aerosol generating substrate (if in fluid connection with an inlet and outlet of the housing) to prevent overheating and combustion of the aerosol-generating substrate during operation.

The chambers 220, 221 depicted in FIG. 4 are tightly packed hexagonal pyramids. Sidewall 227 of one chamber 220 forms a sidewall of another chamber. Due to the tight-packed nature and adjacent sidewalls, conductive heat transfer between chambers 220, 221 is facilitated.

Referring to FIG. 5, a schematic cross-sectional view of an alternative example of an array 225 of chambers 220 is shown. The shaded chambers 220 illustrate chambers that contain aerosol-generating substrate, and the unshaded chamber 221 illustrates an empty chamber. The array 225 is an array of tightly packed cylinders forming the aerosol-generating substrate-containing chambers 220. Between the cylinders, roughly triangular shaped empty chambers 221 are formed. The empty chamber 221 may serve as a heat sink or may transfer excess heat from chambers 220 containing aerosol generating substrate (if in fluid connection with an inlet and outlet of the housing) to prevent overheating and combustion of the aerosol-generating substrate during operation.

Transfer of heat between the aerosol-generating substrate-containing chambers 220 in the array 225 depicted in FIG. 5 tends to be less efficient than transfer between chambers in, for example, the array depicted in FIG. 4 due to less contact or sharing of side-walls of the aerosol-generating substrate-containing chambers 220 in the array 225 depicted in FIG. 5. However, due to their shape, the chambers 220 depicted in FIG. 5 may be particularly well suited for inductive hating due to the limited surface area that may be parallel to an inductive magnetic field.

Referring to FIG. 6, a schematic cross-sectional view of an alternative example of an array 225 of chambers 220 is shown. The array 225 is an array of tightly packed square pyramids. One or more of the chambers 220 may be empty (not shown) and serve as a heat sink or may transfer excess heat from chambers 220 containing aerosol generating substrate (if in fluid connection with an inlet and outlet of the housing) to prevent overheating and combustion of the aerosol-generating substrate during operation.

Transfer of heat between the aerosol-generating substrate-containing chambers 220 in the array 225 depicted in FIG. 6 tends to be efficient due to less contact or sharing of sidewalls 227.

It will be understood that the examples of arrays of chambers depicted in FIGS. 4-6 are shown merely for purposes of example and that other arrays and shapes of chambers may be employed.

Referring now to FIG. 7, a schematic perspective view of an example of a cartridge 150 having a frustro-conical shape is shown. Of course, the cartridge may have any suitable shape.

Referring now to FIG. 8, a schematic sectional drawing of an example of a shisha assembly 100 is shown. The assembly 100 includes a vessel 17 defining an interior volume configured to contain liquid 19 and defining a headspace outlet 15 above a fill level for the liquid 19. The liquid 19 preferably comprises water, which may optionally be infused with one or more colorants, one or more flavorants, or one or more colorants and one or more flavorants. For example, the water may be infused with one or both of botanical infusions or herbal infusions.

The device 100 also includes an aerosol-generating element 130. The aerosol-generating element 130 includes a cartridge receptacle 140 configured to receive a cartridge 150 containing an aerosol-generating substrate. The aerosol-generating element 130 also includes a heating element 160 that forms at least two surfaces of the receptacle 140. In the depicted embodiment, the heating element 160 defines the top and side surfaces of the receptacle 140. The aerosol-generating element 130 also includes a fresh air inlet channel 170 that draws fresh air into the device 100. A portion of the fresh air inlet channel 170 is formed by the heating element 160 to heat the air before the air enters the receptacle 140. The pre-heated air then enters the cartridge 150, which is heated by heating element 160, to carry aerosol generated by aerosol generating substrate in the container 150. The air exits the aerosol outlet 180 of the aerosol-generating element 130.

A conduit 190 carries the air and aerosol from the aerosol outlet 180 into the vessel 17 below the level of the liquid 19. The air and aerosol may bubble through the liquid 19 and exit the headspace outlet 15 of the vessel aerosol-generating element 13017 aerosol-generating element 130. A hose 20 may be attached to the headspace outlet 15 to carry the aerosol to the mouth of a user. A mouthpiece 25 may be attached or form a part of the hose 20.

The air flow path of the device, in use, is depicted by thick arrows in FIG. 8.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 140.

The control electronics 30 and power supply 35 may be located in any suitable position of the aerosol generating element 130 other than the bottom portion of the element 130 as depicted in FIG. 8.

FIG. 9 shows a schematic sectional view of an example of an aerosol-generating element 130. Not all components are shown for purposes of brevity and clarity. In the illustrated embodiment, air (arrows) enters in air inlets 171 in an upper part 131 of the aerosol-generating element 130, then passes through a heat shield 165, then follows the outside surface of the heating element 160 and arrives to the top of the heating element 160. The heated air then goes through a top surface of a housing of the cartridge 150, through the aerosol-generating substrate 155, and through a void in a bottom part 133, down to the aerosol outlet 180. In the depicted embodiment, the air travels along the outer surface of the heating element 160 and then through the heating element 160.

In the example depicted in FIG. 9, the upper part 131 may be removed from the lower part 133 to allow the cartridge 150 to be inserted or removed from the receptacle formed by the heating element 160 and the top surface of the bottom part 131.

FIG. 10 shows a schematic sectional view of an example of an aerosol-generating element 130. Not all components are shown for purposes of brevity and clarity. In the illustrated embodiment, air (arrows) enters in air inlets 171 in an upper part 131 of the aerosol-generating element 130, then passes through a heat shield 165 and heating element 160. The air then follows the inside surface of the heating element 160 and an outer surface of the housing of the cartridge 150, and arrives to the top of the housing of the cartridge 150. The heated air then goes through a top surface of a housing of the cartridge 150, through the aerosol-generating substrate 155, and through a void in a bottom part 133, down to the aerosol outlet 180. In the depicted embodiment, the air travels through the heating element 160 and along the inner surface of the heating element 160.

In the example depicted in FIG. 10, the upper part 131 may be removed from the lower part 133 to allow the cartridge 150 to be inserted or removed from the receptacle formed by the heating element 160 and the top surface of the bottom part 131.

In the examples depicted in FIGS. 9-10, the bodies of the upper part 131 may be formed from thermally insulating material.

In the embodiment, depicted in the schematic sectional view of FIG. 11 the aerosol-generating element 130 includes a thermocouple 199 operably coupled to control electronics (not shown in FIG. 11). In the depicted example, the thermocouple 199 penetrates into the cartridge 150 and aerosol generating substrate 155. The thermocouple 199 may penetrate into the cartridge 150 when the cartridge 150 is positioned on the bottom part 133 and the upper part 131 is placed over the bottom part 131. The thermocouple 199 may be in contact with the heating element 160, in proximity to the outlet 180, or in any other suitable location to provide feedback of a relevant temperature when the shisha device is in use.

The features described above in relation to one aspect of the invention may also be applicable to another aspect of the invention.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

The invention claimed is:

1. A shisha consumable cartridge comprising:

a housing having an exterior surface sized and shaped for operable insertion into a shisha device;

a first chamber in the housing;

a first aerosol-generating substrate in the first chamber;

a second chamber in the housing, wherein the second chamber is adjacent to the first chamber;

a second aerosol-generating substrate in the second chamber, wherein the compositions of the first aerosol-generating substrate and the second aerosol-generating substrate are the same or different;

wherein the first chamber defines a first fresh air inlet and an opposing first aerosol outlet, such that, in use, fresh air entering the first fresh air inlet carries aerosol generated from through the first aerosol outlet;

wherein the second chamber defines a second fresh air inlet and an opposing second aerosol outlet, such that, in use, fresh air entering the second fresh air inlet carries aerosol generated from through the second aerosol outlet; and wherein the first and second chambers, each independently, have an aspect ratio of at least 1.5:1, or at least 2:1, or at least 3:1.

2. The shisha consumable cartridge according to claim 1, further comprising one or more additional chambers in addition to the first and second chambers.

3. The shisha consumable cartridge according to claim 2, wherein at least one of the chambers is empty.

4. The shisha consumable cartridge according to claim 1, wherein the chambers are formed from thermally conductive material.

5. The shisha consumable cartridge according to claim 4, wherein the thermally conductive material comprises aluminium.

6. The shisha consumable cartridge according to claim 1, wherein the cartridge is formed from a magnetic induction susceptor material.

7. The shisha consumable cartridge according to claim 6, wherein the first and second chambers are cylindrical chambers.

8. The shisha consumable cartridge according claim 1, wherein the first and second chambers have polygonal cross-sectional shapes along a majority of their lengths.

9. The shisha consumable cartridge according to claim 8, wherein the cross-sectional shapes are hexagonal.

10. The shisha consumable cartridge according to claim 9, wherein at least one sidewall of the first chamber is a sidewall of the second chamber.

11. The shisha consumable cartridge according to claim 10, wherein the first and second chambers are part of a honeycomb array of chambers.

12. The shisha consumable cartridge according to claim 11, wherein the array of chambers comprises at least 7 chambers.

13. A shisha assembly comprising:

a vessel defining an interior configured to contain a volume of liquid, the vessel comprising a head space outlet conduit;

an aerosol-generating element in fluid connection with the vessel, the aerosol-generating element comprising:

a cartridge receptacle configured to receive a shisha consumable cartridge, according to claim 1;

a heating element in thermal contact with the shisha consumable cartridge, wherein the heating element is configured (i) to heat different chambers of the cartridge at different temperatures, (ii) to heat different chambers of the cartridge at different times, (iii) to heat one or more chambers of the cartridge using varying temperature profiles, or any combination of one or more of (i)-(iii); and an aerosol outlet in fluid connection with the cartridge receptacle and a fresh air inlet channel in fluid connection with the cartridge receptacle.

14. A shisha assembly comprising:

a vessel defining an interior configured to contain a volume of liquid, the vessel comprising a head space outlet conduit;

an aerosol-generating element in fluid connection with the vessel, the aerosol-generating element comprising:

a cartridge receptacle configured to receive a shisha consumable cartridge, according to claim 1, wherein a material forming the first and second chambers comprises a magnetic susceptor material;

an inductive heating element configured to heat the susceptor material when the cartridge is received in the receptacle, wherein the heating element is configured (i) to heat different chambers of the cartridge at different temperatures, (ii) to heat different chambers of the cartridge at different times, (iii) to heat one or more chambers of the cartridge using varying temperature profiles, or any combination of one or more of (i)-(iii); and an aerosol outlet in fluid connection with the cartridge receptacle and a fresh air inlet channel in fluid connection with the cartridge receptacle.

15. The shisha assembly according to claim 13, wherein the shisha device is configured to control heating of the heating element such that the aerosol-generating substrate in the shisha consumable cartridge is sufficiently heated to generate an aerosol but not to cause the aerosol-generating substrate to burn during operation.

16. The shisha consumable cartridge according to claim 1, wherein at least one of the first aerosol-generating substrate and the second aerosol-generating substrate comprises tobacco.

* * * * *